United States Patent [19]

Henkenjohann

[11] Patent Number: 4,986,331

[45] Date of Patent: Jan. 22, 1991

[54] CLOSURE OPENABLE AND CLOSABLE BY A DRIVE FOR AN APERTURE, SUCH AS A DOOR OR GATE, COMPRISING INTERHINGED SLATS

[75] Inventor: Gerda Henkenjohann, Verl, Fed. Rep. of Germany

[73] Assignee: Firma Johann Henkenjohann, Verl, Fed. Rep. of Germany

[21] Appl. No.: 329,990

[22] Filed: Mar. 29, 1989

[30] Foreign Application Priority Data

Apr. 8, 1988 [DE] Fed. Rep. of Germany ..... 3811704

[51] Int. Cl.[5] ..... E06B 3/38

[52] U.S. Cl. ..... 160/201; 160/311

[58] Field of Search ..... 160/201, 133, 310, 311

[56] References Cited

U.S. PATENT DOCUMENTS

| | | | |
|---|---|---|---|
| 2,263,995 | 11/1941 | Katulski | 160/201 X |
| 2,850,088 | 9/1958 | Purdy | 160/201 X |
| 2,947,354 | 8/1960 | Netoux | 160/201 X |
| 4,379,479 | 4/1983 | Whiting | 160/201 |
| 4,628,646 | 12/1986 | Eyerle | 160/133 X |

FOREIGN PATENT DOCUMENTS

| | | | |
|---|---|---|---|
| 683060 | 12/1966 | Belgium . | |
| 716068 | 12/1931 | France | 160/201 |
| 7044497 | 7/1972 | France . | |
| 502258 | 11/1954 | Italy | 160/201 |
| 534722 | 9/1958 | Italy | 160/178.1 |
| 1486550 | 9/1977 | United Kingdom . | |
| 2134166 | 8/1984 | United Kingdom . | |

*Primary Examiner*—Blair M. Johnson

*Attorney, Agent, or Firm*—Marmorek, Guttman & Rubenstein

[57] ABSTRACT

The invention relates to a drive for closures of apertures, more particularly sectional gates. The sectional gate is made up of slats 1*a*–1*c* directly hinged to one another and guided in vertical and horizontal rails 3, 5 on both longitudinal edges. In the deflecting zone between the vertical portion and the horizontal portion of the aperture closure, associated with each edge of the aperture closure is a sprocket wheel 6 engaging with a roller chain. The rollers 21–24 of the roller chain are disposed on pivot pins 17–20 borne by locking members 10–12. The locking members 10–12 are inserted in the ends of every second hollow slat 1*a*, 1*b*, 1*c*. The pivot pins 17–20 are so arranged as to be in alignment with the hinge points 13–15 of the slats 1*a*–1*e* hinged to one another.

10 Claims, 7 Drawing Sheets

Figure 1:
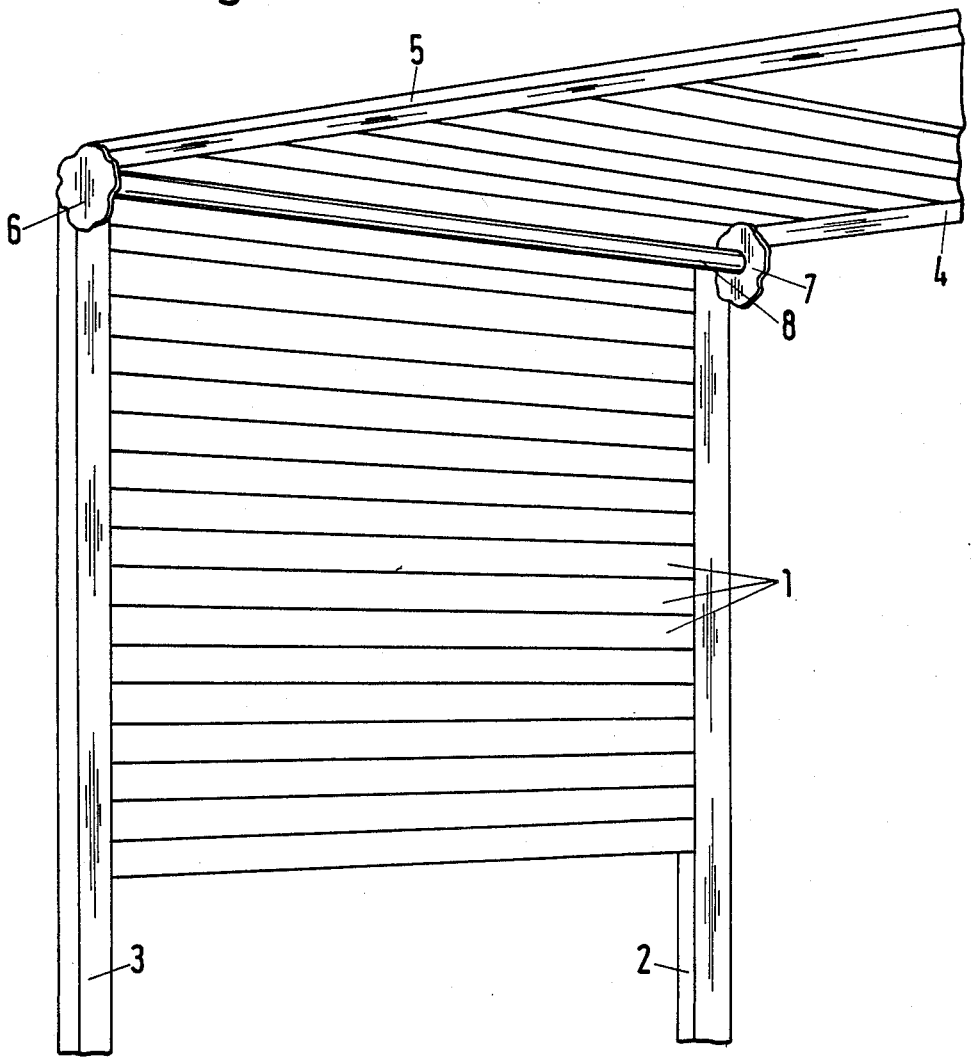

CLOSURE OPENABLE AND CLOSABLE BY A DRIVE FOR AN APERTURE, SUCH AS A DOOR OR GATE, COMPRISING INTERHINGED SLATS

The invention relates to a closure openable and closable by a drive for an aperture, such as a door or gate, comprising interhinged slats which are guided in rails at the two lateral edges of the closure and are deflected from a first plane into a second plane during opening and closing.

A closure for an aperture of the kind specified is known from French Patent Specification 2 116 869. One feature of such closures, also known as "sectional gates", is that they have a constant length, in contrast with sliding shutters, which can be drawn out in length. In this prior art closure, attached at the hinge points of the slats and constructed more particularly in the form of pivot pins of a link chain are entraining members which are engaged by driving wheels, more particularly constructed in the frame of sprocket wheels, provided in the deflection zone of the closure. In comparison with another drive, in which a pulling means is made fast to the top slat, this kind of closure drive has the advantage that the slats disposed between the place of deflection and the attachment of the pulling means are not loaded by the weight of that part of the closure which hangs down in front of the place of deflection. Such loading is more particularly critical if the adjacent interengaging longitudinal edges of the slats form the joints and no additional relief is provided for such joints. In the prior art closure having a drive provided in the zone of deflection of the closure, disposed on both longitudinal edges of the closure are chains whose pivot pins are disposed at the hinge points of the slat. The hinge pins are borne by plugs inserted in the ends of cylindrical hollow members disposed between the longitudinal edges, constructed in the form of matching bearing shells, of adjacent slats. The link chains ensure the cohesion of the hollow slats and cylindrical hollow members which are not directly interconnected. However, it is a disadvantage that the cost of manufacturing and assembling such a closure is high.

It is an object of the invention to provide a closure of simpler construction.

This problem is solved in a first embodiment by the following features:

(a) The closure comprises hollow slats hinged to one another and engaging in one another throughout their length.

(b) The two lateral edges of the closure are so guided in rails that during opening and closing the closure is deflected from a first plane into a second plane.

(c) Inserted in the ends of each second hollow slat are locking members which engage over the ends of the adjacent slats in each case and secure the slats against neutral longitudinal displacement.

(d) The locking members bear entraining elements at the hinged points of the slats.

(e) Driving wheels engage with the entraining members in the deflection zone of the closure.

In a second embodiment the solution consists in the following features:

(a) The closure comprises hollow slats hinged to one another and engaging in one another throughout their length.

(b) The two lateral edges of the closure are so guided in rails that during opening and closing the closure is deflected from a first plane into a second plane.

(c) The joints of adjacent slats comprise an open circular cylindrical bearing shell provided at the longitudinal edge of one slat, and a circular cylindrical lug which is mounted in the bearing shell and disposed at the adjoining longitudinal edge of the other slat and into whose two hollow ends plugs are inserted which cooperate with a collar engaging over the bearing shell to secure the adjacent slat against mutual longitudinal displacement.

(d) The plugs bear entraining members at the hinge points of the slats.

(e) Driving wheels engage with the entraining members in the deflection zone of the closure.

According to an advantageous feature of the invention, the entraining members take the form of pivot pins of a link chain and the driving wheels are sprocket wheels.

In comparison with the prior art closure, which has driving wheels in the zone of deflection, the closure according to the invention is simpler, since although a link chain is advantageous to hold together the parts of the closure, it is not necessary, since the hollow slats are self-holding, due to their direct interhinging. The drive can be put into effect with conventional slats; no special section is required. The only additional expenditure for the drive is that the locking members and plugs bear entraining members for the driving wheels. Such expenditure is negligible in comparison with that in the case of the prior art closure, which has hollow slats and cylindrical hollow members and link chains disposed therebetween.

If link chains are provided at the lateral edges of the closure, advantageously the link chain has on its pivot pins two rows of connecting straps which are disposed laterally spaced-out from one another and between which the sprocket wheels engage. Also advantageously the pivot pins are equipped with guide rollers. The guide rollers can have a larger diameter than the straps and be guided in the rails.

When the closure is inserted through the driving wheels into the rails of the second, substantially horizontal plane, usually the closure is not completely supported at its underside. However, to prevent the closure from sagging at this place of transition between the supporting driving wheel and the horizontal rail, according to one feature of the invention the link chains disposed on both longitudinal sides of the closure have at their hinge points securing means against bending which act on one side in the direction of the driving wheels. Since on the side remote from the driving wheels the link chain is supported by the lengthened rail and therefore cannot bend on that side, on the side of the driving wheels—i.e., in the downward direction—it is retained by the securing means against bending, so that the closure can be inserted in the extended position without problems through the driving wheels into the guide rails.

Preferably, the securing means against bending are formed on the connecting straps. This can be put into effect, for example, by the feature that each securing means against bending, disposed beyond the hinge point of the link chain on the side remote from the driving wheel, comprises a stop borne by a connecting strap and an abutment which cooperates with such stop and is borne by the adjacent connecting strap.

Figure 2:
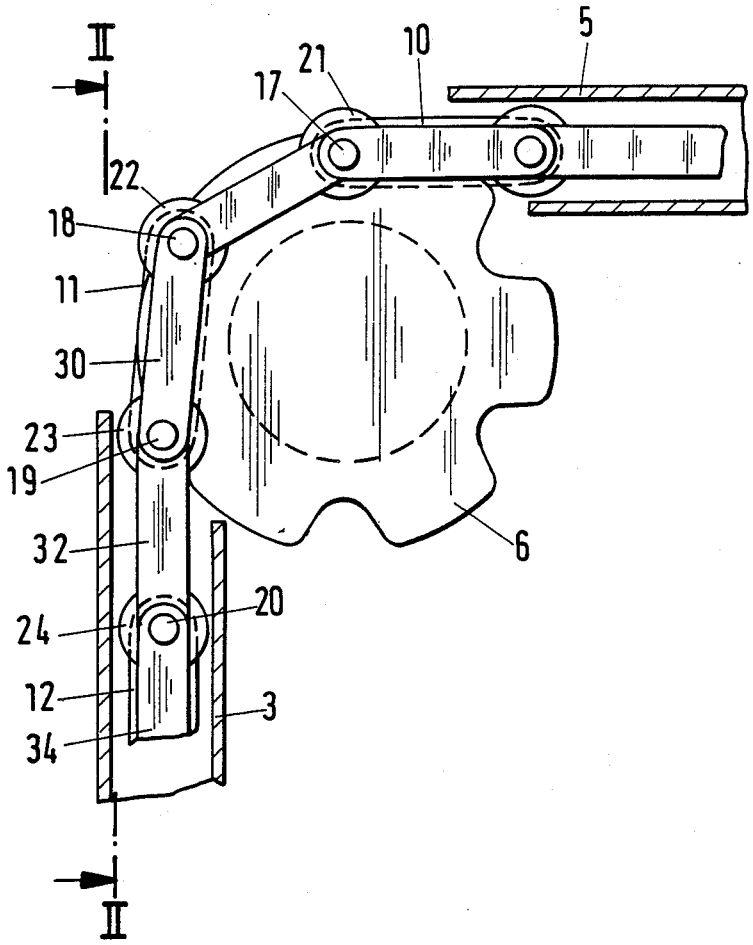
Figure 3:
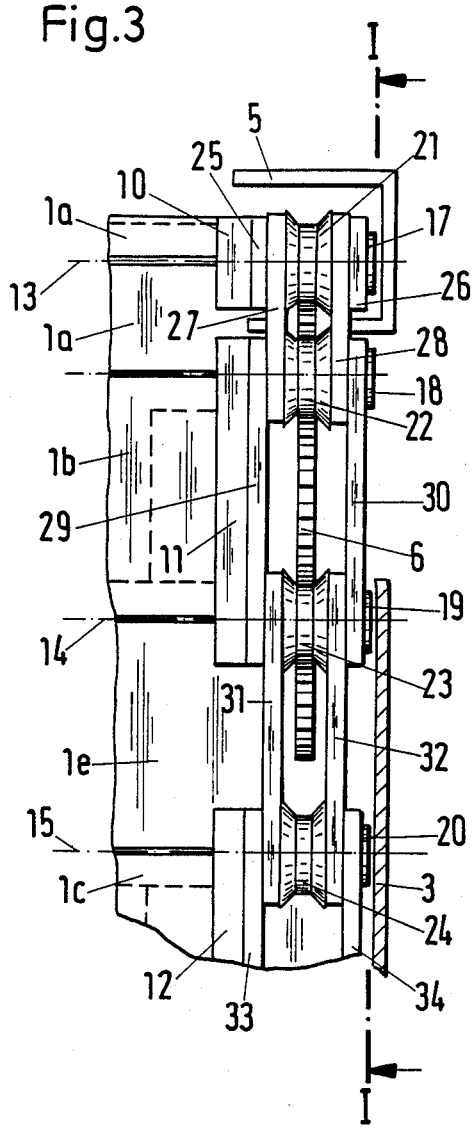
Figure 5:
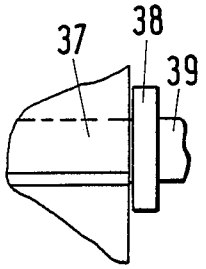
Figure 4:
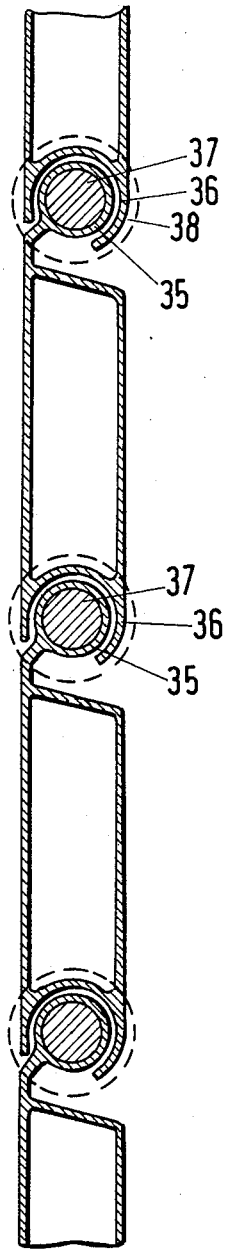
Figure 6:
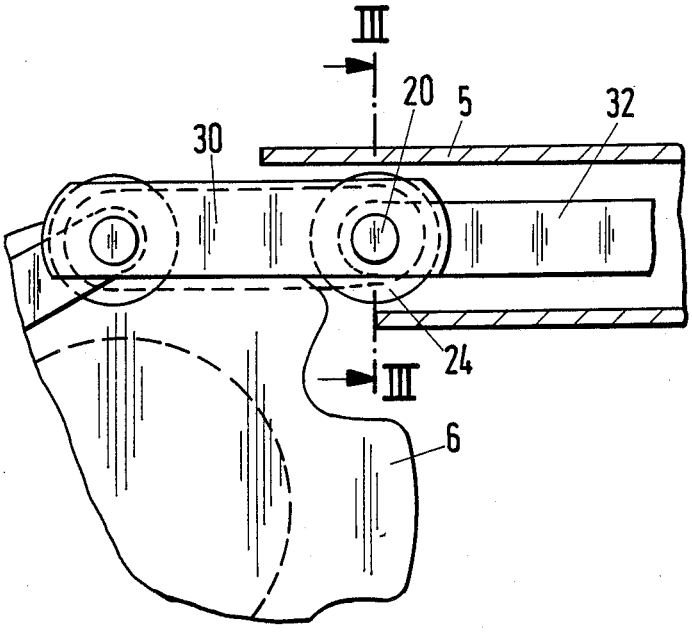
Figure 7:
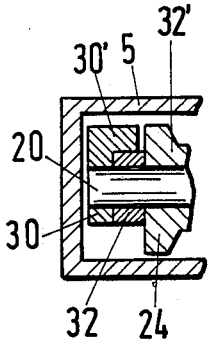
Figure 8:
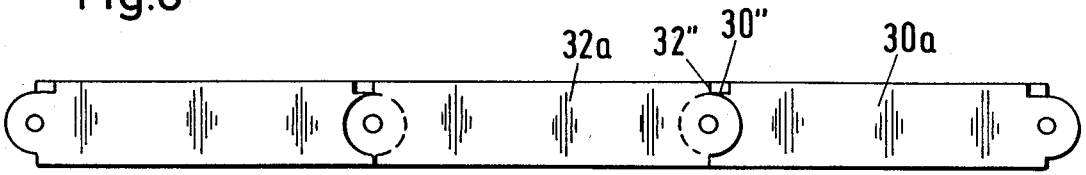
Figure 9:
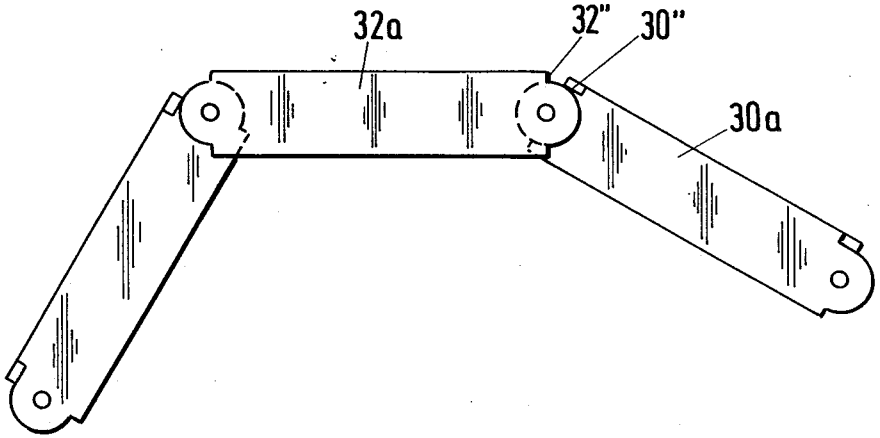

An embodiment of the invention will now be described in greater detail with reference to the drawings, wherein:

FIG. 1 is a diagrammatic perspective view of a closure comprising interhinged slats, FIG. 2 shows the closure illustrated in FIG. 1 in the zone of its drives, on a scale enlarged on FIG. 1, sectioned along the line I—I in FIG. 3, FIG. 3 shows the closure illustrated in FIG. 2, sectioned along the line II—II in FIG. 2, FIGS. 4 and 4(*a*) show in cross-section and to an enlarged scale a detail of a closure comprising interhinged slats, in a different embodiment from FIG. 1, FIG. 5 is a view of a detail of the closure illustrated in FIG. 4 at a hinge point, FIG. 6 shows to an enlarged scale the closure illustrated in FIG. 2 with an additional securing means against bending, FIG. 7 shows the closure illustrated in FIG. 6, partially sectioned along the line III—III in FIG. 6, FIG. 8 is a side elevation of a link chain in the extended position for a closure illustrated in FIG. 1 and having a different securing means against bending from that shown in FIGS. 6 and 7, and FIG. 9 is a side elevation of the link chain illustrated in FIG. 8, shown in the position bent to one side.

The closure in the form of a sectional gate shown in FIG. 1 comprises a plurality of slats 1 which are directly interhinged via moulded-on members and are guided in a vertical plane and a horizontal plane at their two lateral edges in U-shaped sectional rails 2, 3, 4, 5. Disposed in the zone of deflection between the vertical plane and the horizontal plane is a drive having two driving wheels 6, 7 which are jointly driven, for example, by a tube motor 8. In the zone of deflection the slats 1 are positively driven and guided by the driving wheels 6, 7 in a manner disclosed hereinafter.

As can be seen from FIG. 2, inserted in each second hollow slat 1*a*, 1*b*, 1*c* is a locking member 10, 11, 12 which differs from the conventional locking members by the feature that at the hinge points 13, 14, 15 between the successive slats 1*a* to 1*e* bear pins 17, 18, 19, 20 which form the pivot pins of a link chain, more particularly a roller chain with rollers 21, 22, 23, 24 and straps 25, 26, 27, 28, 29, 30, 31, 32, 33, 34. The pitch of the roller chain therefore corresponds to the pitch of the interhinged slats 1. The sprocket wheel 6 engages in the roller chain. To facilitate the engagement of the disc-shaped sprocket wheel 6 in the roller chain, the rollers 21 to 24 are wedge-shaped.

In the closure shown in FIGS. 4, 4(*a*) and 5 the slats are again directly interhinged at the hinge points by moulded-on members.

An open cylindrical bearing shell 36 having a hollow cylindrical lug 35 mounted therein is moulded on the longitudinal edges of adjacent slats. Disposed in the open ends of each lug 35 are plugs 37 which bear a collar 38 and a pivot pin 39 taking the form of an entraining member of a link chain. The collars 38 secure the adjacent slats against mutual longitudinal displacement. However, the function of the collars can also be performed by rollers disposed on the pivot pins 39 or by the connecting straps of the link chains.

In FIGS. 6 and 7, which show a variant embodiment in comparison with the one illustrated in FIGS. 2 and 3, a securing means against bending is provided on one side. The securing means comprise a stop 30′ , which takes the form of a web engaging over an inner connecting strap 32 at the edge of the outer connecting strap 30 remote from the driving wheel 6, and an abutment 32′ which is formed by the edge of the inner strap 32 remote from the driving wheel 6. The stop 30′, extends beyond the hinge point formed by the pivot pin 20. The securing means against bending ensures that in the zone in which the link chain is not supported either by the driving wheels 6 or the rail 5, the link chain and therefore the closure also cannot bend in the direction of the driving wheel 6. Since any bending of the link chain and the closure towards the side remote from the driving wheel 6 is prevented by the rail 5 extended on one side as far as the zone of the driving wheel 6, the link chain and therefore the closure also is guided in the extended position and can be inserted through the driving wheel 6 into the rail 5, without being able to bende on one side or the other.

In the embodiment illustrated in FIGS. 8 and 9, in the securing member against bending the stop 30″ is formed by a downwardly bent lug of the inner connecting strap 30*a*, the abutment 32′ being formed by an edge of a step at the top edge of the outer connecting strap 32*a*.

I claim:

1. A retractable closure for an opening, comprising
   - a plurality of hollow slats, spanning the width of said opening, hinged to each other throughout their lengths, by means of hinges between said slats,
   - locking means for securing the slats against longitudinal displacement attached to alternate ends of said slats, said locking means dimensioned to engage adjacent ends of said slats,
   - entraining means, fastened to said locking means, and coaxial with axes of said hinges between said slats,
   - a first pair and a second pair of guide rails, defining first and second planes, and spaced apart so as to receive said entraining means,
   - a link chain attached to said entraining means, said link chain comprising connecting links, said entraining means comprising the pivot pins of said link chain,
   - a pair of drive wheels in driving engagement with said entraining means, said drive wheels being located in the deflection zone between said first and second planes, and
   - means for securing said link chain against bending in a direction opposite to the direction of bending over said drive wheels, said securing means comprising a stop disposed on a first connecting link and an abutment which cooperates with said stop disposed on an adjacent connecting link.

2. A retractable closure as in claim 1 wherein said link chain comprises two rows of spaced apart connecting links, and wherein said drive wheels drivingly engage said pivot pins between said spaced apart connecting links.

3. A retractable closure as in claim 2 wherein said pivot pins are equipped with guide wheels.

4. A retractable closure as in claim 3 wherein the diameter of said guide wheels is larger than the width of said links and wherein said guide wheels are guided in said guide rails.

5. A retractable closure as in claim 1 wherein first alternate links of said link chain are wider than second alternate links of said link chain, and said first alternate links have right-angle projection members at each end which engage the tops of said second alternate links and prevent bending of said link chains in a direction opposite to the direction of bending over said drive wheels.

6. A retractable closure for an opening, comprising a plurality of hollow slats, spanning the width of said opening, hinged to each other throughout their lengths, a first and second pair of guide rails, defining a first and a second plane, and enclosing the ends of said slats, said slats having hinges comprising a circular-cylindrical housing with an axial slot along one edge of a first slat, and a mating circular-cylindrical bearing along the neighboring edge of a second slat, entraining pins, inserted in each end of said circular-cylindrical housing, and on which are mounted a retaining collar sized to prevent longitudinal displacement between said slats, and on which are mounted entraining means for guiding engagement with said first and second pairs of guide rails, a link chain attached to said entraining means, said link chain comprising connecting links, said entraining means comprising the pivot pins of said link chain, a pair of drive wheels in driving engagement with said entraining means, said drive wheels being located in the deflection zone of said first and second planes, and means for securing said link chain against bending in a direction opposite to the direction of bending over said drive wheels, said securing means comprising a stop disposed on a first connecting link and an abutment which cooperates with said stop and is disposed on an adjacent connecting link.

7. A retractable closure as in claim 6, wherein said link chain comprises two rows of spaced apart connecting links and wherein said drive wheels drivingly engage said pivot pins between said spaced apart connecting links.

8. A retractable closure as in claim 7 wherein said pivot pins are equipped with guide wheels.

9. A retractable closure as in claim 8 wherein the diameter of said guide wheels is larger than the width of said links and wherein said guide wheels are guided in said guide rails.

10. A retractable closure as in claim 6 wherein first alternate links of said link chain are wider than second alternate links of said link chain, and said first alternate links have right-angle projection members at each end which engage the tops of said second alternate links and prevent bending of said link chains in a direction opposite to the direction of bending over said drive wheels.

* * * * *